United States Patent [19]

Sonoda et al.

[11] Patent Number: 4,517,029

[45] Date of Patent: May 14, 1985

[54] PROCESS FOR THE COLD FORMING OF IRON AND STEEL

[75] Inventors: Sakae Sonoda, Yokohama; Yoshio Nagae, Ayase; Seishi Kano, Ichikawa, all of Japan

[73] Assignee: Parker Chemical Company, Madison Heights, Mich.

[21] Appl. No.: 500,713

[22] Filed: Jun. 3, 1983

[30] Foreign Application Priority Data

Jun. 4, 1982 [JP] Japan ..... 57-94686

[51] Int. Cl.[3] ..... C23F 7/10

[52] U.S. Cl. ..... 148/6.15 Z

[58] Field of Search ..... 148/6.15 Z

[56] References Cited

U.S. PATENT DOCUMENTS

| | | | |
|---|---|---|---|
| 2,859,145 | 11/1958 | Somers | 148/6.15 Z |
| 2,884,351 | 4/1959 | Cavanagh | 148/6.15 Z |
| 3,144,360 | 8/1964 | Palm | 148/6.15 Z |
| 3,161,549 | 12/1964 | Kallenbach | 148/6.15 Z |
| 3,218,200 | 11/1965 | Henricks | 148/6.15 Z |

FOREIGN PATENT DOCUMENTS

| | | | |
|---|---|---|---|
| 560569 | 7/1958 | Canada | 148/6.15 Z |

*Primary Examiner*—Sam Silverberg

*Attorney, Agent, or Firm*—Arthur E. Kluegel

[57] ABSTRACT

Iron and steel articles to be subjected to a cold forming operation are treated with a phosphatizing solution to form a zinc phosphate film on the surface, which film contains from about 5 to 80% by weight of the total film of zinc calcium phosphate. Thereafter, a soap type lubricant coating is applied to the zinc phosphate film. Preferably, the zinc phosphate film is formed on the surface by treating it with a phosphatizing solution which comprises from about 0.1 to about 0.35% by weight calcium ion, from about 0.1 to about 1.5% by weight zinc ion, from about 0.5 to about 3.0% by weight $PO_4$, and from about 3.0 to about 5.0% by weight nitrate ion, which solution has a weight ratio of calcium ions:zinc ions of about 0.1–1.0:1 and a weight ratio of nitrate ions:$PO_4$ of about 1.0–5.0:1. One or more of nickel, copper or cobalt ions may also be included in the phosphatizing solution in a total amount of from about 0.01 to about 0.2% by weight of the solution.

3 Claims, No Drawings

PROCESS FOR THE COLD FORMING OF IRON AND STEEL

This invention relates to an improved process for the cold forming of iron and steel and, more particularly, it relates to the application of an improved lubricant coating on the iron and steel surfaces before they are subjected to the cold forming operation.

BACKGROUND OF THE INVENTION

In processes for the cold working or forming of iron and steel materials, it is well known in the art to apply a lubricant composition to the metal surface to be deformed in order to eliminate, or at least minimize, the friction between the material to be processed and the metal working tool or die. Typically, where only simple deformation or forming is involved, the desired lubrication has been provided by the application of oils to the metal surface, which oils may be emulsified and/or contain one or more additives to improve the lubricity of the oil during the forming operation. Where more severe metal forming or deformation is involved, it has been customary to provide, on the surface of the metal to be deformed, a zinc phosphate film hopeite) or a mixed film of zinc phosphate and zinc iron phosphate (phosphophyllite) as the base layer to which is applied a fatty acid soap lubricant composition, such as a sodium stearate or zinc stearate soap.

In recent years, as the shape of the cold formed articles have become more complex and the hardness of the iron and steel materials to be deformed has increased, the cold forming operations have become increasingly severe with the result that even where lubricant films utilizing the prior art phosphate coatings have been employed, problems of coining and/or stick-slip phenomena have been frequently encountered. For example, in cold forging processes, the degree of cold working per process, i.e., the cross section reduction ratio, has reached 80%, with the result that the surface temperatures of the material being processed rises to 300° C. and higher. This has frequently resulted in the thermal decomposition or even physical destruction of the prior art phosphate films during the cold forming operation.

In an attempt to overcome these problems, lubricant materials having good heat resistance, such as molybdenum disulphide and graphite have been used, either alone or in combination with a phosphate film. These materials, when used alone, have been found to have poor adhesion to the surface of the iron or steel material to be deformed and, hence, have not produced satisfactory results. Even when used in combination with a phosphate film, due to the thermal decomposition or physical destruction of this film during the forming operation, the combination has not provided any significant improvement.

The problems described above have also begun to be encountered in processes for the cold drawing of iron or steel pipe and wire, although such processes have not heretofore been considered to involve the high degrees of deformation as in a cold forming process. This has been caused by an increase in the speed at which the drawing operation has been carried out and by the use of harder, less malleable iron and steel materials. The result has been a significant increase in the severity of the working which has been accompanied by problems of scorching, and severe tool friction, which has resulted in a significant decrease in tool life and an increase in tool cost.

It is, therefore, an object of the present invention to provide an improved process for the cold forming or working of iron and steel materials.

A further object of the present invention is to provide an improved lubricant system, by the use of which the aforementioned problems in present cold forming operations will be greatly minimized, if not overcome.

These and other objects will become apparent to those of ordinary skill in the art from the description of the invention which follows:

SUMMARY OF THE INVENTION

Pursuant to the above objects, it has now been found that significant improvements in the lubricity of the lubricant system are obtained, with consequent reduction in the problems heretofore encountered in the cold forming process, by forming on the surface of the iron and steel materials to be deformed a zinc phosphate film or coating which contains from about 5 to about 80% by weight of the total phosphate film of zinc calcium phosphate and, thereafter, applying to such film a conventional alkali metal soap lubricant. This particular phosphate coating has been found to provide an excellent substrate film for the subsequently applied soap lubricant and the resulting total lubricant system provides excellent lubricity and formability even under heavy, severe cold forming conditions.

DETAILED DESCRIPTION OF THE INVENTION

More specifically, the zinc phosphate film containing from about 5 to about 80% by weight of zinc calcium phosphate is preferably formed by treating the surface of the iron and steel materials which are to be subjected to cold forming operations with an aqueous phosphate solution which comprises from about 0.1 to about 0.35% by weight calcium ion, from about 0.1 to about 1.5% by weight zinc ion, from about 0.5 to about 3.0% by weight $PO_4$, and from about 3.0 to about 5.0% by weight nitrate ion, which solution has a weight ratio of calcium ions to zinc ions of 0.1–1.0:1 and a weight ratio of nitrate ion to $PO_4$ of 1.0–5.0:1. Treatment of the iron and steel materials to be subjected to the cold forming operation with this solution produces a zinc phosphate film on the surface which contains from about 5 to about 80% by weight of zinc calcium phosphate, which film provides an excellent substrate for the application of a conventional soap type lubricant. Such soap type lubricant is applied to the phosphate coated materials in the known manner and, thereafter, the materials are subjected to a cold forming operation.

In using the above-described phosphatizing solution to form the desired zinc phosphate film containing zinc calcium phosphate, it has been found that where the amount of calcium ions in the solution are less than about 0.1% by weight, the amount of zinc calcium phosphate formed in the film is not sufficient to provide the lubricity necessary for severe or hevy cold forming operations. Additionally, it has been found that where the calcium ion content is above about 0.35% by weight, excessive amounts of zinc calcium phosphate are formed in the film with a resulting reduction in the total weight of the phosphate film and in the amount of metal soap formed by the reaction of the sodium soap lubricant which is applied and the phosphate film. This, again, causes the entire lubricant system to be unsatisfactory for severe or heavy cold forming operations.

With respect to the zinc ions, it has been found that where its concentration is below about 0.1% by weight, difficulties are encountered in forming the desired zinc phosphate film on the substrate being treated. When the zinc ion concentration in the phosphatizing solution is increased above about 1.5% by weight, there is a reduction in the zinc calcium phosphate formation in the film, thus making it unsuitable for use in heavy or severe cold forming processes.

It has further been found that where the concentration of $PO_4$ in the above-described phosphatizing solution is below about 0.5% by weight, it is very difficult, if not impossible, to form a phosphate film which is a suitable substrate for the subsequently applied soap lubricant. If the $PO_4$ content is increased above about 3.0% by weight, additional quantities of phosphate are consumed in the coating reaction without any significant improvement in the phosphate film produced. Thus, such additional quantities of $PO_4$ serve no apparent useful purpose and merely add to the total cost of operating the process.

In the case of the nitrate ion, it has been found that where its concentration in the phosphatizing solution is below about 3.0% by weight, this amount is not sufficient to oxidize all of the iron that is dissolved in the bath from the substrates being treated to the ferric state. This results in an accumulation of ferrous iron in the bath which forms an undesirable sludge. When the nitrate ion content of the bath is increased above about 5.0% by weight, the crystal structure of the phosphate film becomes coarse and is not suitable for use in severe or heavy cold forming operations.

It has further been found in the use of the phosphatizing solutions described above that the weight ratio of calcium ions to zinc ions is also important. When the calcium ion/zinc ion ratio is below about 0.1, very little zinc calcium phosphate is formed in the film so that the film has little if any resistance to heavy or severe cold forming operations. Where the calcium ion/zinc ion ratio exceed about 1.0, the zinc phosphate film formed becomes substantially all zinc calcium phosphate. This results in an appreciable redcution in the amount of metal soap formed by the reaction of the sodium soap lubricant with the phosphate film and results in a total lubricant system which has little if any resistance to heavy or severe cold forming operations. A particularly satisfactory ratio of calcium ions:zinc ions in the phosphatizing solution has been found to be about 0.2–0.7:1. This effect of the calcium ion/zinc ion ratio is shown in the following Table 1:

TABLE 1

| Ca/Zn (wt. ratio) | Amount of metal soap formed by reaction with sodium soap ($g/m^2$) | Proportion of zinc calcium phosphate in phosphate film (%) |
|---|---|---|
| 0 | 5.2 | 0 |
| 0.1 | 5.0 | 5 |
| 0.25 | 4.4 | 22 |
| 0.50 | 3.8 | 45 |
| 0.75 | 2.9 | 62 |
| 1.0 | 1.6 | 78 |
| 1.25 | 0.7 | 100 |
| 1.5 | 0.7 | 100 |
| 2.0 | 0.6 | 100 |

With regard to the ratio of nitrate ion to $PO_4$, this too has been found to be important in regard to the use of the phosphatizing solution described above. Where this ratio is below about 1.0 or above about 5.0, similar results are obtained as when the concentration of nitrate ion in the phosphatizing solution is below 3.0% by weight or above 5.0% by weight.

Preferably, these phosphatizing solutions are formulated from zinc phosphate, calcium phosphate, phosphoric acid, sodium nitrate, nitric acid, and the like. Other compounds containing zinc, calcium, $PO_4$ and nitrate ions may also be used, as is well known in the art, so long as the compound utilized has sufficient solubility in water to provide the desired concentration of the particular ions and, further provided, that the anions or cations associated therewith do not have a detrimental effect on either the phosphatizing solution or the resulting phosphate film formed on the metal surfaces treated. As has been noted, the formulation of such phosphatizing solutions is conventional and well known in the art.

In some instances, particularly where extremely heavy or severe forming operations are to be performed, it has been found that it is desirable to increase the weight of the phosphate coating produced by this solution. In this regard, it has been found that further improvements in the cold workability under conditions of very heavy or severe cold forming can be achieved by including one or more metal ions selected from nickel, copper or cobalt, in the phosphatizing solution. When these metal ions are included in the phosphatizing solutions, the weight of the phosphate film is increased while the amount of zinc calcium phosphate in the film remains unchanged. Typically, these metal ions may be included in the solution in amounts within the range of about 0.01 to about 0.2% by weight of the total of the metal ions that are added. Generally, it has been found that total amounts of metal ions less than about 0.01% by weight have no significant effect on increasing the weight of the phosphate film, while total amounts in excess of about 0.2% by weight do not produce any significant further increase in the film coating weight. Typically, the metal ions may be added as nickel nitrate, nickel carbonate, copper nitrate, copper carbonate, cobalt nitrate, cobalt carbonate, and the like.

The iron and steel surfaces may be treated with the phosphatizing solution described in any convenient manner, as is well known in the art. Typically, the articles to be treated are first surface cleaned by degreasing, pickling, mechanical descaling or the like. Thereafter, the phosphatizing solutions are applied by immersion or spray methods. The surfaces treated are maintained in contact with the phosphatizing solution for a period of time sufficient to form the desired coating weight of phosphate film on the surface.

Thereafter, a soap lubricant composition is applied to the phosphate film on the iron and steel surfaces to be subjected to cold forming operations. Any of the well known soap type lubricants may be applied to the thus-formed phosphate coating. These soap-type lubricants are well known in the art and are generally aqueous compositions containing up to 30% by weight or more of a fatty acid soap per se, or of components which react to form the soap in situ in the composition. Thus, these compositions may contain a fatty acid soap or a fat or an oil and an alkaline material such as an alkali metal hydroxide or carbonate. Typical of the fatty acid soap used or formed in situ are those which contain from about 8 to 22 carbon atoms and particularly those which contain from about 12 to 18 carbon atoms. These soap-type lubricants are well known in the art and are applied to the metal surface on which the phosphate film has been formed in any convenient manner, typically by immersion of the phosphate coated material in the soap composition. The soap is maintained in contact with the phosphate coated substrate for a period sufficient to form the desired soap lubricant coating on the surface and permit the reaction of the alkali metal, e.g., sodium, soap with the metallic portion of the phosphate coating to form the desired amount of metal soap in the film. Thereafter, the work piece is dried and then subjected to the desired cold forming or working operation.

In order that those skilled in the art might better understand the present invention and the manner in which it may be practiced, the following specific examples are given. In these examples, the iron or steel work piece was pickled, water washed and then treated with the phosphatizing solution specified by immersion in the solution for ten minutes at 80° C. The work piece was then immersed in an aqueous soap lubricant composition containing 70 grams per liter of a commercial sodium stearate soap composition sold under the trademark BONDERLUBE ® 235 by Occidental Chemical Corporation for five minutes at 75° C. The work piece was then removed from the soap solution, dried and subjected to the indicated cold forming operation.

In the following examples, aqueous phosphatizing solutions were formulated containing the components in the amounts indicated:

TABLE 2

| Composition | Example 1 | 2 | 3 | 4 | 5 | 6 | 7 |
|---|---|---|---|---|---|---|---|
| Ca ion concentration (%) | 0.16 | 0.25 | 0.25 | 0.32 | 1.0 | 0.3 | — |
| Zn ion concentration (%) | 0.8 | 0.5 | 0.5 | 0.4 | 0.80 | 0.31 | 0.8 |
| Phosphate ion concn. (%) | 1.2 | 1.8 | 0.0 | 1.2 | 1.0 | 0.68 | 1.2 |
| Nitrate ion concn. (%) | 3.6 | 3.6 | 4.0 | 3.6 | 5.0 | 1.04 | 3.6 |
| Ca/Zn (weight ratio) | 0.2 | 0.5 | 0.5 | 0.8 | 1.25 | 1.00 | — |
| $ClO_3$ | — | — | — | — | — | 0.27 | — |
| $NO_3/PO_4$ (weight ratio) | 3.0 | 2.0 | 4.0 | 3.0 | 5.0 | 1.53 | 3.0 |

STB 42 steel tubing was treated in the manner described hereinabove to form the total lubricant coating using the treating solutions of Examples 1 through 7, and was then drawn in a drawing machine. The drawing power and core of metal force were measured and, the external appearance of the tubing after drawing was visually assessed. Prior to drawing, the tubing had an outside diameter or 25.4 millimeters and a wall thickness of 2.50 millimeters. After drawing, the outer diameter was 20.0 millimeters and the wall thickness was 1.55 millimeters. The degree of working (cross section reduction ratio) was 50% and the drawing speed was 17.8 meters per minute. Using this procedure, the following results were obtained:

TABLE 3

| Example | Drawing force (kg) | Core metal force (kg) | External Appearance after drawing | No. bad/ No. drawn | Phosphate film wt. ($g/m^2$) |
|---|---|---|---|---|---|
| 1 | 6420 | 425 | Internal and external | 0/100 | 14.1 |
| 2 | 6350 | 405 | surfaces | 0/100 | 12.5 |
| 3 | 6390 | 410 | all completely satisfactory | 0/100 | 12.0 |
| 4 | 6450 | 430 | Flaws developed | 0/100 | 10.9 |
| 5 | 6610 | 475 | along internal surface | 13/100 | 8.5 |
| 6 | 6630 | 483 | Metal soap residue small | 9/100 | 8.3 |
| 7 | 6480 | 474 | Internal surface slight flaw development | 2/100 | 15.5 |

SCM3 wire material was treated in accordance with the procedure set forth hereinabove to form the lubricant coating on the surface, using treating solutions of Examples 1 through 7. Thereafter, the wire was drawn three times on a drawing machine. After each time, the phosphate film weight remaining on the wire was measured and the proportion of residual film determined in relation to the theoretical value. Additionally, after drawing, the amount of residue on the die as observed as well as the appearance of the drawn wire. Prior to drawing, the wire had a diameter of 12 millimeters and after the first, second and third drawing, had a diameter of 10.0 millimeters, 8.5 millimeters, and 7.0 millimeters, respectively. The drawing speed used was 17.8 meters per minute. Using this procedure, the following results were obtained:

TABLE 4

| Example | Film wt. ($g/m^2$) | 1st drawing Film wt. | 1st drawing Resid. % | 2d drawing Film wt. | 2d drawing Resid. % | 3d drawing Film wt. | 3d drawing Resid. % | No. poor/ No. drawn | Residual on die |
|---|---|---|---|---|---|---|---|---|---|
| 1 | 11.2 | 9.0 | 97 | 6.7 | 84 | 4.7 | 72 | 3/100 | Mod. |
| 2 | 10.0 | 8.1 | 98 | 6.2 | 87 | 4.5 | 77 | 0/100 | Small |
| 3 | 9.5 | 7.7 | 98 | 5.8 | 86 | 4.2 | 77 | 0/100 | Small |
| 4 | 8.3 | 6.8 | 99 | 4.7 | 79 | 3.5 | 72 | 2/100 | Small |
| 5 | 6.5 | 5.2 | 96 | 3.5 | 76 | 2.5 | 65 | 12/100 | Small |
| 6 | 6.3 | 5.0 | 96 | 3.4 | 77 | 2.3 | 62 | 15/100 | Small |
| 7 | 12.4 | 10.1 | 98 | 7.0 | 80 | 4.5 | 63 | 5/100 | Large |

TABLE 5

Where:

$$\text{residual } \% = \frac{\text{residual film wt.}}{\text{theoretical residual film wt.}} \times 100\%$$

$$= \frac{\text{actual residual film wt.}}{\text{initial film wt.} \times \sqrt{1-\gamma}} \times 100\%$$

$\gamma$ = degree of working

In order to illustrate the affect of the addition of metal ions to the phosphatizing compositions, the following phosphatizing compositions were formulated containing the components in the amounts indicated:

TABLE 6

| Composition | EXAMPLES 8 | 9 | 10 | 11 |
|---|---|---|---|---|
| Calcium ion concn. (%) | 0.32 | 0.34 | 0.32 | 0.34 |

TABLE 6-continued

| Composition | EXAMPLES 8 | 9 | 10 | 11 |
|---|---|---|---|---|
| Zinc ion concn. (%) | 0.4 | 0.34 | 0.4 | 0.34 |
| Phosphate ion concn. (%) | 1.2 | 1.2 | 1.2 | 1.2 |
| Nitrate ion concn. (%) | 3.6 | 3.6 | 3.6 | 3.6 |
| Ca/Zn (weight ratio) | 0.8 | 1.0 | 0.8 | 1.0 |
| $NO_3/PO_4$ (wt. ratio) | 3.0 | 3.0 | 3.0 | 3.0 |
| Nickel ion concn. (%) | 0.1 | 0.1 | — | — |

SCM3 wire was treated in accordance with the procedure set forth hereinabove to form the lubricant coating on the surface, using the treating solutions of Examples 8 through 11. Thereafter, the wire was drawn four successive times on a drawing machine and after each drawing, the film weight was measured. After the fourth draw, the appearance of the drawn wire and the amount of residue on the die were observed. Prior to drawing, the wire had an outer diameter of 12.0 millimeters. After the first, second, third and fourth draw, the outer diameter of the wire was 10.0 millimeters, 8.5 millimeters, 7.0 millimeters, and 6.0 millimeters, respectively, the drawing speed used was 17.8 meters per minute. Using this procedure, the following results were obtained.

TABLE 7

| Example | initial film wt. | 1st time drawing film weight ($g/m^2$) | 2d time drawing film weight ($g/m^2$) | 3d time drawing film weight ($g/m^2$) | 4th time drawing film weight ($g/m^2$) | No. poor/ No. drawn | Residual on die |
|---|---|---|---|---|---|---|---|
| 8 | 11.0 | 8.9 | 6.2 | 4.7 | 3.6 | 0/100 | small |
| 9 | 9.5 | 7.6 | 5.3 | 3.9 | 3.0 | 2/100 | small |
| 10 | 8.3 | 6.8 | 4.7 | 3.5 | 2.7 | 10/100 | small |
| 11 | 7.0 | 5.6 | 3.9 | 2.7 | 2.0 | 15/100 | small |

While it will be apparent that the invention herein disclosed is well calculated to achieve the benefits and advantages as hereinabove set forth, it will be appreciated that the invention is susceptible to modification, variation and change without departing from the scope thereof.

What is claimed is:

1. In a process for treating iron and steel articles to form, on the surface thereof, a lubricant coating suitable for providing lubricity during a cold forming operation by first forming a phosphate film on the surface of the iron and steel articles and, thereafter, forming a coating of a soap-type lubricant on the phosphate film, the improvement which comprises forming the phosphate film by treating the article with an aqueous phosphatizing solution comprising from about 0.1 to about 0.35% by weight calcium ions, from about 0.1 to about 1.5% by weight zinc ions, from about 0.5 to about 3.0% by weight $PO_4$ and from about 3.0 to about 5.0% by weight nitrate ions, which solution has a weight ratio of calcium ions: zinc ions of about 0.1–1.0:1 and weight ratio of nitrate ions: $PO_4$ of about 1.0–5.0:1, to form a zinc phosphate film which contains from about 5 to about 80% by weight of the total phosphate film of zinc calcium phosphate and thereafter contacting the phosphate film with an aqueous reactive alkali metal soap composition which reacts to form a coating thereon followed by drying.

2. The process as claimed in claim 1 wherein the aqueous phosphatizing solution also contains metal ions selected from nickel, copper, cobalt, and mixtures thereof in a total amount of about 0.01 to about 0.2% by weight of the solution.

3. the process as claimed in claim 2 wherein the weight ratio of calcium ion:zinc ion is about 0.2–0.7:1.

* * * * *